US012447381B1

(12) United States Patent
Niksich

(10) Patent No.: US 12,447,381 B1
(45) Date of Patent: Oct. 21, 2025

(54) SPORTS BALL HOLDER

(71) Applicant: Gene Niksich, Alpharetta, GA (US)

(72) Inventor: Gene Niksich, Alpharetta, GA (US)

( * ) Notice: Subject to any disclaimer, the term of this patent is extended or adjusted under 35 U.S.C. 154(b) by 157 days.

(21) Appl. No.: 18/372,887

(22) Filed: Sep. 26, 2023

(51) Int. Cl.
*A63B 47/00* (2006.01)
*A45F 5/02* (2006.01)

(52) U.S. Cl.
CPC ..... *A63B 47/001* (2013.01); *A45F 5/021* (2013.01)

(58) Field of Classification Search
CPC ..... A45F 5/021; A63B 47/001; Y10S 224/919
See application file for complete search history.

(56) References Cited

U.S. PATENT DOCUMENTS 2,548,330 A * 4/1951 Wiseman ..... A63B 47/001 224/919
4,042,156 A * 8/1977 Knight ..... A63B 47/001 206/315.9
4,062,482 A * 12/1977 Szalony ..... A63B 57/20 294/166
4,088,251 A * 5/1978 Rodriguez ..... A63B 47/001 206/315.9
5,139,189 A * 8/1992 Hanley ..... A63B 47/001 224/678
6,168,061 B1 * 1/2001 Harrison ..... A63B 47/001 224/919
6,193,120 B1 * 2/2001 Chang ..... A63B 57/20 206/315.9
7,500,570 B2 * 3/2009 Kurcheski ..... A63B 47/00 211/14
9,526,317 B2 * 12/2016 Willows ..... B65D 1/40
2015/0352409 A1 * 12/2015 Darr ..... A63B 57/20 206/315.9

* cited by examiner

*Primary Examiner* — Adam J Waggenspack
(74) *Attorney, Agent, or Firm* — Gulf Coast Itellectual Property Group

(57) ABSTRACT

A sports ball holder to that is configured to be worn by a user during play of a game wherein the sports ball holder is configured to releasably secure at least one sports ball. The present invention includes a center portion having a first side and a second side. The center portion further includes a divider member intermediate the first side and second side. A wall member is present on the first side and second side wherein the wall member extends outward on both the first side and second side defining a portion of the first receiving area and the second receiving area. The wall member on the first side and the second side additionally include arm members wherein the arm members extend outward from the wall member defining a periphery of the first receiving area and the second receiving area.

4 Claims, 2 Drawing Sheets

SPORTS BALL HOLDER

FIELD OF THE INVENTION

The present invention relates generally to sporting equipment and accessories, more specifically but not by way of limitation, a pickleball holder wherein the present invention is configured to receive and retain two pickleballs and is worn by a user during play of the game so as to facilitate rapid access to a replacement pickleball.

BACKGROUND

Pickleball is a paddle sport where players hit a perforated, hollow plastic ball with paddles over a net until and volley back and forth until one player or team is unsuccessful at returning the volley, much like tennis. Pickleball can be played indoors or outdoors and was invented in Washington state in the 1960's. The game resembles tennis and has a similarly laid out court but has several differences and follows a different set of rules.

The court for pickleball is smaller being about twenty feet wide and forty four feet in length. The court further includes a non-volley area proximate the net on both sides thereof. As players play the game and engage in a volley, at the end of the volley many times the plastic ball will bounce away from the court and must be retrieved. Retrieval of the pickleball requires time that takes away from the game and further can be a challenge for some players.

Accordingly, there is a need for a pickleball holder that is configured to receive and store pickleballs wherein the present invention can be worn by a user during play so as to facilitate replacement of a pickleball during a game.

SUMMARY OF THE INVENTION

It is the object of the present invention to provide a pickleball holder configured to be worn by a user during play of the game wherein the present invention includes a body wherein the body is manufactured from a suitable material such as but not limited to plastic.

Another object of the present invention is to provide a pickleball holder operable to receive and retain two pickleballs worn by a user during play of a game wherein the body includes a center portion wherein the center portion includes a first side and a second side and wherein the center portion further includes a divider member.

A further object of the present invention is to provide a pickleball holder configured to be worn by a user during play of the game wherein the center portion includes a wall member integrally formed on the first side thereof defining a first receiving area.

Yet a further object of the present invention is to provide a pickleball holder operable to receive and retain two pickleballs worn by a user during play of a game wherein the center portion includes a wall member integrally formed on the second side thereof defining a second receiving area.

Still another object of the present invention is to provide a pickleball holder configured to be worn by a user during play of the game wherein the wall member formed on the first side of the center portion includes arm members integrally formed therewith and extending outward therefrom.

An additional object of the present invention is to provide a pickleball holder operable to receive and retain two pickleballs worn by a user during play of a game wherein the wall member formed on the second side of the center portion includes arm members integrally formed therewith and extending outward therefrom.

Yet a further object of the present invention is to provide a pickleball holder configured to be worn by a user during play of the game wherein the center portion has integrally formed thereon a clip member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
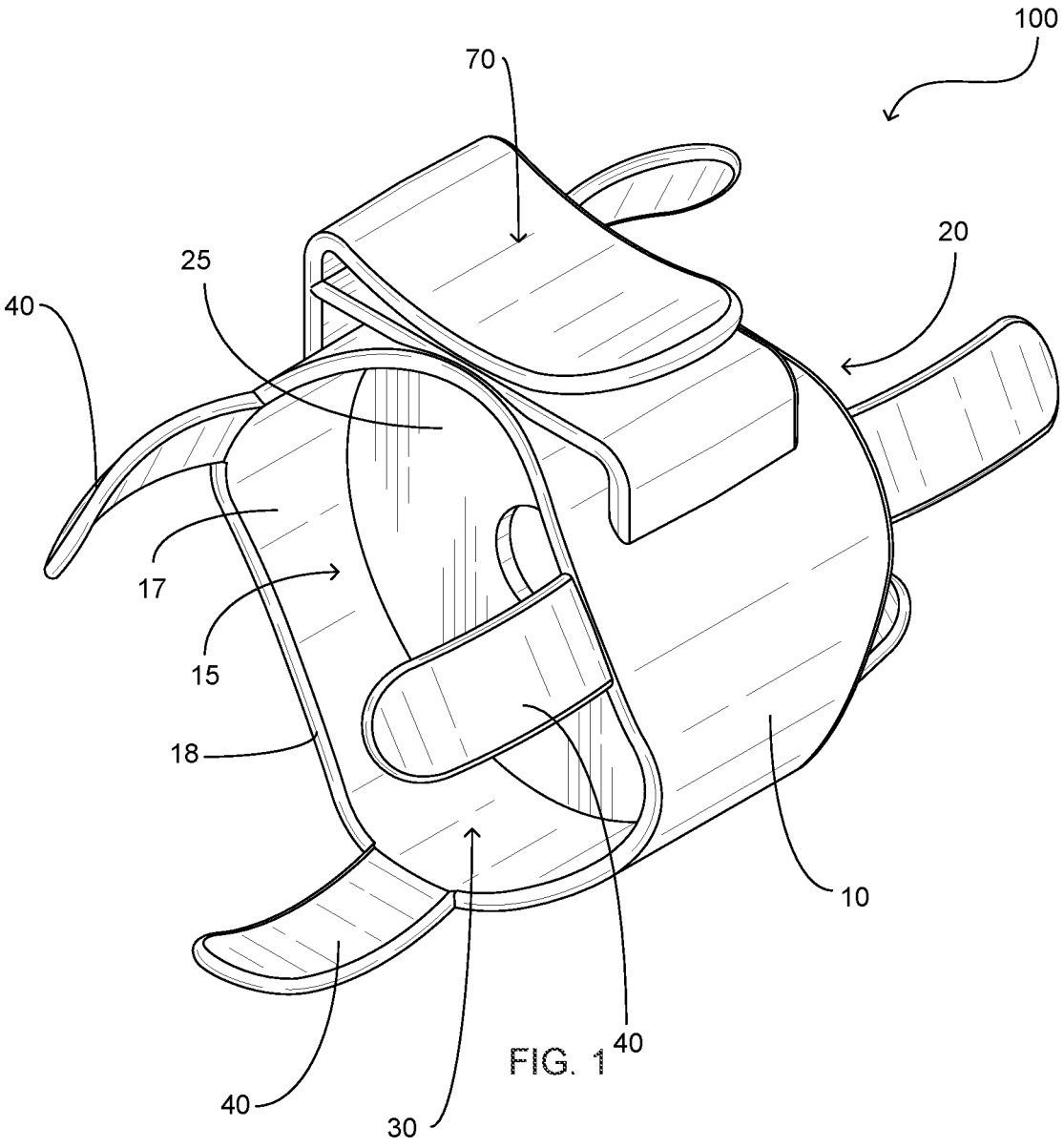
FIG. 1 is a perspective view of the present invention.
Figure 2:
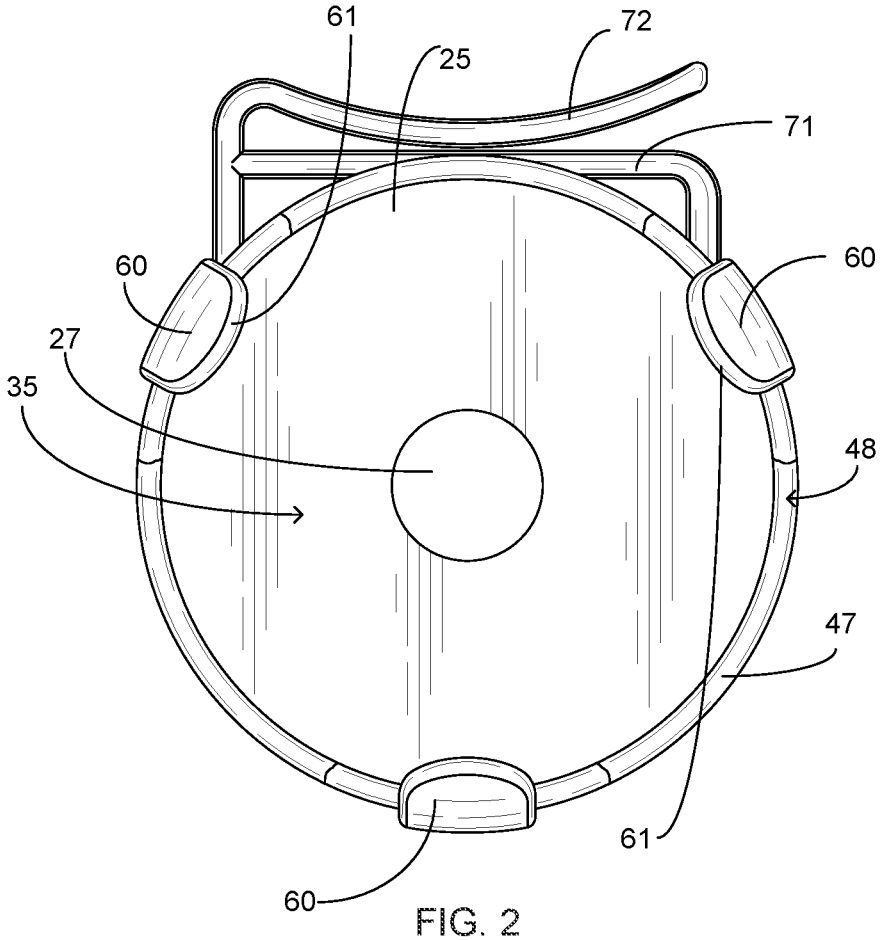
FIG. 2 is an end view of the present invention.

Referring now to the drawings submitted herewith, wherein various elements depicted therein are not necessarily drawn to scale and wherein through the views and figures like elements are referenced with identical reference numerals, there is illustrated a sports ball holder 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the sports ball holder 100 is manufactured from a suitable lightweight material such as but not limited to plastic. The sports ball holder 100 includes a center portion 10 wherein the center portion 10 includes a first side 15 and a second side 20. Intermediate the first side 15 and the second side 20 is the divider member 25. The divider member 25 includes center aperture 27 and functions to separate the first receiving area 30 and the second receiving area 35. The first side 15 includes wall member 17 wherein the wall member 17 extends outward from the divider member 25 and defines a portion of the first receiving area 30. The wall member 17 includes upper perimeter edge 18 that is undulated in shape. It should be understood within the scope of the present invention that the upper perimeter edge 18 could be a consistent height around the perimeter of the wall member 17 instead of the undulated shape illustrated herein. The wall member 17 extends outward at a sufficient distance and has a diameter that is operable to assist in providing retention of a sports ball that has been disposed in the first receiving area 30.

The first side 15 further includes arm members 40. The arm members 40 are integrally formed with the upper perimeter edge 18 of the wall member 17 and extend outward therefrom. The arm members 40 are arcuate in shape and manufactured from a material that includes characteristics such as but not limited to resilient or malleable. The arm members 40 are resilient in order to be biased outwards during insertion of a ball and then return to retain the ball subsequent insertion. The arm members 40 are arcuate in shape so as to bias the ends 41 inward towards the first receiving area 30. The arm members 40 are planar having a sufficient width to engage a surface of a sports ball that has been disposed in the first receiving area 30. Additionally, the arm members 40 have a sufficient width so as to inhibit incidental journaling thereof into a hole of a pickleball. While three arm members 40 have been illustrated herein, it should be understood within the scope of the present invention that the sports ball holder 100 could employ less than three arm members 40 or more than three arm members 40 in order to achieve the objective of releasably securing a sports ball in the first receiving area 30.

The second side 20 is constructed identically to the first side 15. The second side 20 includes wall member 47 wherein the wall member 47 extends outward from the divider member 25 and defines a portion of the second receiving area 35. The wall member 47 includes upper perimeter edge 48 that is undulated in shape. It should be understood within the scope of the present invention that the upper perimeter edge 48 could be a consistent height around the perimeter of the wall member 47 instead of the undulated shape. The wall member 47 extends outward at a sufficient distance and has a diameter that is operable to assist in providing retention of a sports ball that has been disposed in the second receiving area 35. The second side 20 further includes arm members 60. The arm members 60 are integrally formed with the upper perimeter edge 48 of the wall member 47 and extend outward therefrom. The arm members 60 are arcuate in shape and manufactured from a material that includes characteristics such as but not limited to resilient or malleable. The arm members 60 are resilient in order to be biased outwards during insertion of a ball and then return to retain the ball subsequent insertion. The arm members 60 are arcuate in shape so as to bias the ends 61 inward towards the second receiving area 35. The arm members 60 are planar having a sufficient width to engage a surface of a sports ball that has been disposed in the second receiving area 35. Additionally, the arm members 60 have a sufficient width so as to inhibit incidental journaling thereof into a hole of a pickleball. While three arm members 60 have been illustrated herein, it should be understood within the scope of the present invention that the sports ball holder 100 could employ less than three arm members 60 or more than three arm members 60 in order to achieve the objective of releasably securing a sports ball in the second receiving area 35.

The sports ball holder 100 further includes a clip member 70 integrally formed on the center portion 10. The clip member 70 is configured to releasably secure the sports ball holder 100 to a belt being worn by an individual or an alternate suitable support structure. The clip member 70 includes first member 71 and second member 72. The second member 72 is arcuate in shape and is biased against the outer surface of the first member 71. The second member 72 is configured to bias against a belt or suitable support structure and maintain between the first member 71 and second member 72 in order to secure the position of the sports ball holder 100. It should be understood within the scope of the present invention that the sports ball holder 100 could employ alternately constructed clip member 70 in order to achieve the objective discussed herein.

While the sports ball holder 100 is illustrated and discussed herein as having a first receiving area 15 and a second receiving area 20, it is contemplated within the scope of the present invention that the sports ball holder 100 could be constructed with one receiving area configured to hold one or more sports balls. By way of example but not limitation, in the aforementioned example only a first side would be constructed having arm members of sufficient length to accommodate sports balls in a linear arrangement.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A pickleball holder wherein the pickleball holder comprises:

a center portion, said center portion having a wall member, said wall member of said center portion being annular in shape, said center portion having a divider member, said divider member being proximate a midpoint of said center portion being disposed within said wall member of said center portion, said divider member having a first side and a second side, said wall member of said center portion having a first portion thereof extending away and outward from said first side of said divider member, said wall member of said center portion having second portion thereof extending away and outward from said second side of said divider member, said first portion of said wall member defining a first receiving area, said second portion of said wall member defining a second receiving area, said first receiving area being adjacent said first side of said divider member, said second receiving area being adjacent said second side of said divider member;

at least four arm members, two of said at least four arm members being integrally formed with said first portion of said wall member extending outward therefrom, two of said at least four arm members being integrally formed with said second portion of said wall member extending outward therefrom, wherein said two of at least four arm member formed with said first portion of said wall member of said first side defining a first receiving area, and wherein said two of at least four arm member formed with said second portion of said wall member operable to define a second receiving area; and wherein said first receiving area and said second receiving area are configured to receive and retain at least one pickleball therein.

2. The pickleball holder as recited in claim 1, wherein said at least four arm members are arcuate in shape, said at least four arm members having end portions being directed inwards to the first receiving area and the second receiving area.

3. The pickleball holder as recited in claim 2, wherein said divider member further includes a center aperture.

4. The pickleball holder as recited in claim 3, and further including a clip member, said clip member being integrally formed with said center portion, said clip member configured to be releasably secured to a belt of a user.

* * * * *